US005338162A

United States Patent [19]

Krarup

[11] Patent Number: 5,338,162

[45] Date of Patent: Aug. 16, 1994

[54] HIGH-PRESSURE CLEANER WITH AIR-COOLED MOTOR

[75] Inventor: Karsten Krarup, Hobro, Denmark

[73] Assignee: K.E.W. Industri A/S, Denmark

[21] Appl. No.: 170,670

[22] Filed: Dec. 20, 1993

Related U.S. Application Data

[63] Continuation of Ser. No. 973,748, Nov. 9, 1992, abandoned.

[30] Foreign Application Priority Data

Dec. 7, 1991 [EP] European Pat. Off. ..... 91121016.9

[51] Int. Cl.[5] ..... F04B 17/00; F04B 35/00

[52] U.S. Cl. ..... 417/367; 417/368; 417/243

[58] Field of Search ..... 417/367, 368, 243

[56] References Cited

U.S. PATENT DOCUMENTS

| | | | |
|---|---|---|---|
| 2,787,720 | 4/1957 | Ethier et al. | 417/367 |
| 4,052,765 | 10/1977 | Gühne et al. | 417/367 |
| 4,125,345 | 11/1978 | Yoshinaga et al. | 417/243 |
| 4,480,967 | 11/1984 | Schulze | 417/368 |

FOREIGN PATENT DOCUMENTS

| | | | |
|---|---|---|---|
| 8400196 | 1/1984 | European Pat. Off. | 417/367 |

*Primary Examiner*—Richard A. Bertsch
*Assistant Examiner*—Alfred Basichas
*Attorney, Agent, or Firm*—Larson and Taylor

[57] ABSTRACT

A high-pressure cleaner includes a pump for pumping cleaning liquid, the drive mechanism of which pump is driven by an air-cooled motor. The cleaner also includes an air cooler adapted to be cooled by the cleaning liquid on its way to the pump and an air-circulating arrangement for circulating air between the motor and the air cooler in an enclosure containing the motor and the air cooler. The part of the air cooler through which the cleaning liquid flows is in intimate thermal contact with or integral with a housing containing the drive mechanism of the pump. With this arrangement, the cooling capacity of the cleaning liquid flowing towards the pump is also used for cooling the mechanism used for moving the pump's pistons, e.g., a swash-plate mechanism or the like.

8 Claims, 3 Drawing Sheets

HIGH-PRESSURE CLEANER WITH AIR-COOLED MOTOR

This application is a continuation of application Ser. No. 07/973,748 filed Nov. 9, 1992, now abandoned.

TECHNICAL FIELD

The present invention relates to a high-pressure cleaner of the kind comprising a pump for pumping cleaning liquid, the pump including a drive mechanism, an air-cooled motor for driving the drive mechanism of the pump, an air cooler adapted to be cooled by said cleaning liquid when the cleaning liquid flows through the air cooler to said pump, and air-circulating means for circulating air between said motor and said air cooler in an enclosure containing the motor and the air cooler.

1. Background Art

A high-pressure cleaner of the kind referred to above is known from the european patent application No. 0 420 473 A1 (Black & Decker Inc.). In this known cleaner, no special provision is made for cooling the drive mechanism of the pump, i.e. the mechanism moving the active parts of the pump, such as pistons. When a high pumping power is to be delivered, such as when the cleaner is to provide a jet of liquid at high speed and a high volume rate, this drive mechanism is subjected to a considerable mechanical load, thus producing heat because of the unavoidable frictional losses.

2. Disclosure of the Invention

It is the object of the present invention to provide a high-pressure cleaner of the kind referred to initially, in which effective cooling of the drive mechanism for the pump is also provided, and this object is achieved with a cleaner, according to the present invention, wherein a liquid-flow part of said air cooler through which said cleaning liquid flows is in intimate thermal contact with or integral with a housing containing the drive mechanism of said pump.

With this arrangement, the cooling capacity of the cleaning liquid flowing towards the pump, in a known manner used for cooling the motor, is also utilized for cooling the drive mechanism of the pump, thus improving the dissipation of the generated heat referred to above.

Advantageous embodiments of the cleaner according to the present invention, the effects of which are explained in the following detailed portion of the present specification, are set forth in claims 2–8.

BRIEF DESCRIPTION OF THE DRAWINGS

In the following detailed specification, the present invention will be explained in more detail with reference to the drawing, in which.

DESCRIPTION OF THE PREFERRED EMBODIMENT

Figure 1:
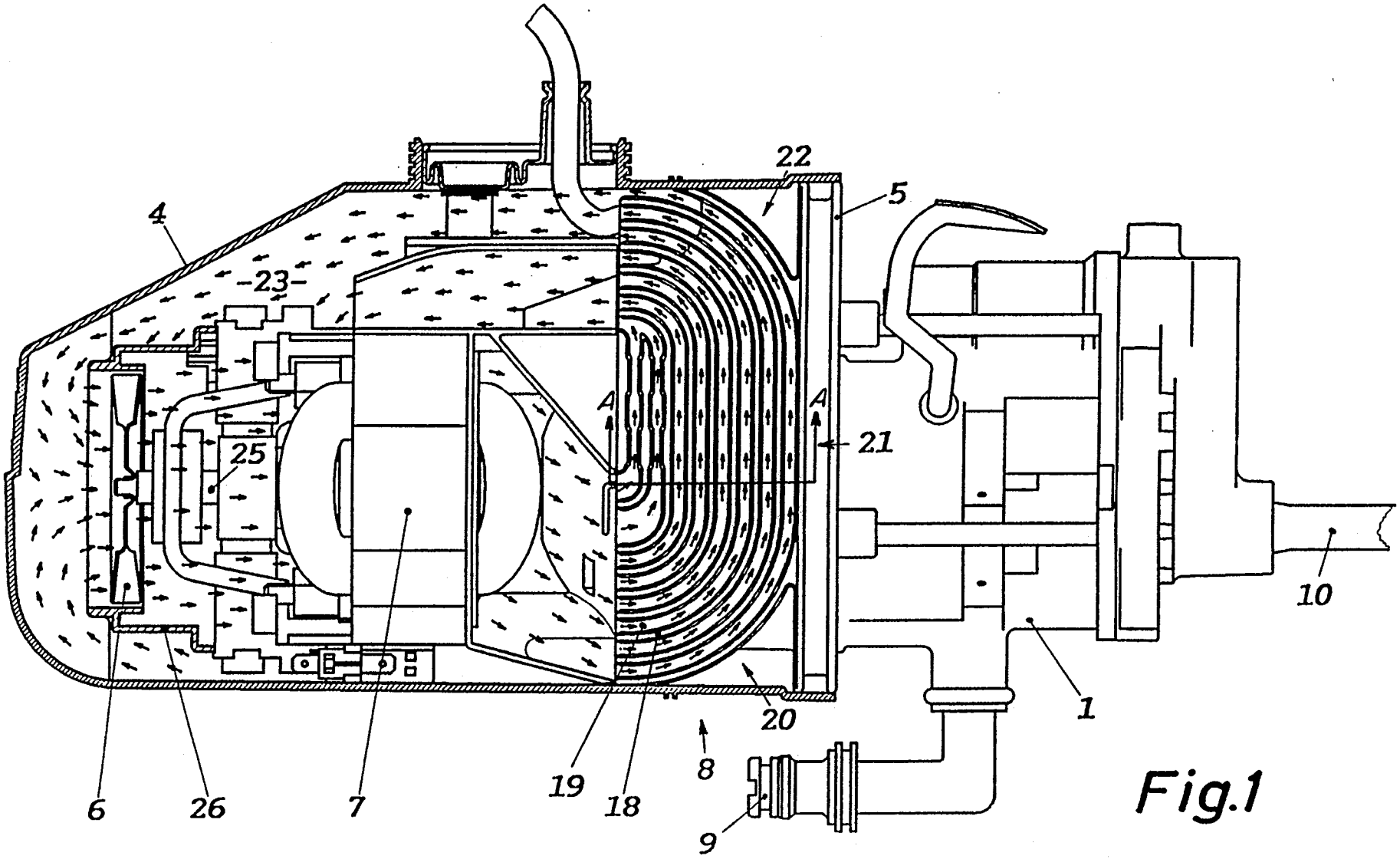
FIG. 1 shows an exemplary embodiment of a cleaner according to the present invention, in a side view with the casing open to show the fan, the motor and the air-flow portion of the air cooler.

The high-pressure cleaner shown in the drawing comprises two housing components, i.e.

a pump housing 1 containing the hydraulically active components of the pump, such as its pistons 2 and associated cylinders 3 (only partly shown in FIG. 2), and a substantially closed casing 4 attached to the pump housing 1 by means of a flange 5 and containing a fan 6, an electric drive motor 7 and an air cooler 8.

The pump comprising the pistons 2 and the cylinders 3 is in the normal manner adapted to receive cleaning liquid through an inlet 9 and to expel this liquid under high pressure through a Jet lance 10, of which only the root portion is shown.

The pump housing 1 is secured to a drive-mechanism housing 11, in the exemplary embodiment shown containing a swash-plate drive mechanism 12 adapted in the normal manner to reciprocate the pistons 2 in a direction parallel to the rotational axis 13 of the drive mechanism 12.

The drive-mechanism housing 11 surrounds the drive mechanism 12 substantially coaxially to the axis and comprises an annular-section flow space 14 constituting the liquid-flow part of the air cooler 8.

At its lowermost point 15, the flow space 14 communicates with the inlet 9 receiving cleaning liquid from a suitable source (not shown), and at its uppermost point 16, it communicates with the inlet conduit 17 of the pump housing 1.

As mentioned above, the annular-section flow space 14 constitutes the liquid-flow part of the air cooler 8. The air-flow part of this air cooler 8 is constituted by a number of ribs 18, forming between them a number of air channels 19. Although it cannot be seen from FIG. 1, as is shown in FIG. 3 (in which the swash-plate drive mechanism 12 is rotated 90° from the position shown in FIG. 2), the ribs 18 are integral parts of the radially outer portion of the drive-mechanism housing 11 containing the flow space 14, so that the ribs 18 can conduct heat from air passing through the air channels 19 to the cleaning liquid flowing through the flow space 14.

The air channels 19 extend more or less parallel to each other through an air-entry portion 20, an intermediate portion 21 and an air-exit portion 22. AS may be seen from FIG. 1, the air-entry portion 20 will receive comparatively hot air from the motor 7, whilst the air-exit portion 22 will deliver cooled air outside of the structure of the motor 7, but within the casing space 23 defined by the casing 4, flowing to the opposite end of the latter, where it is drawn in by the fan 6 and made to flow in circulation through the motor 7, i.g. between the components of the latter, towards the air-entry portion 20 of the air cooler 8.

Figure 2:
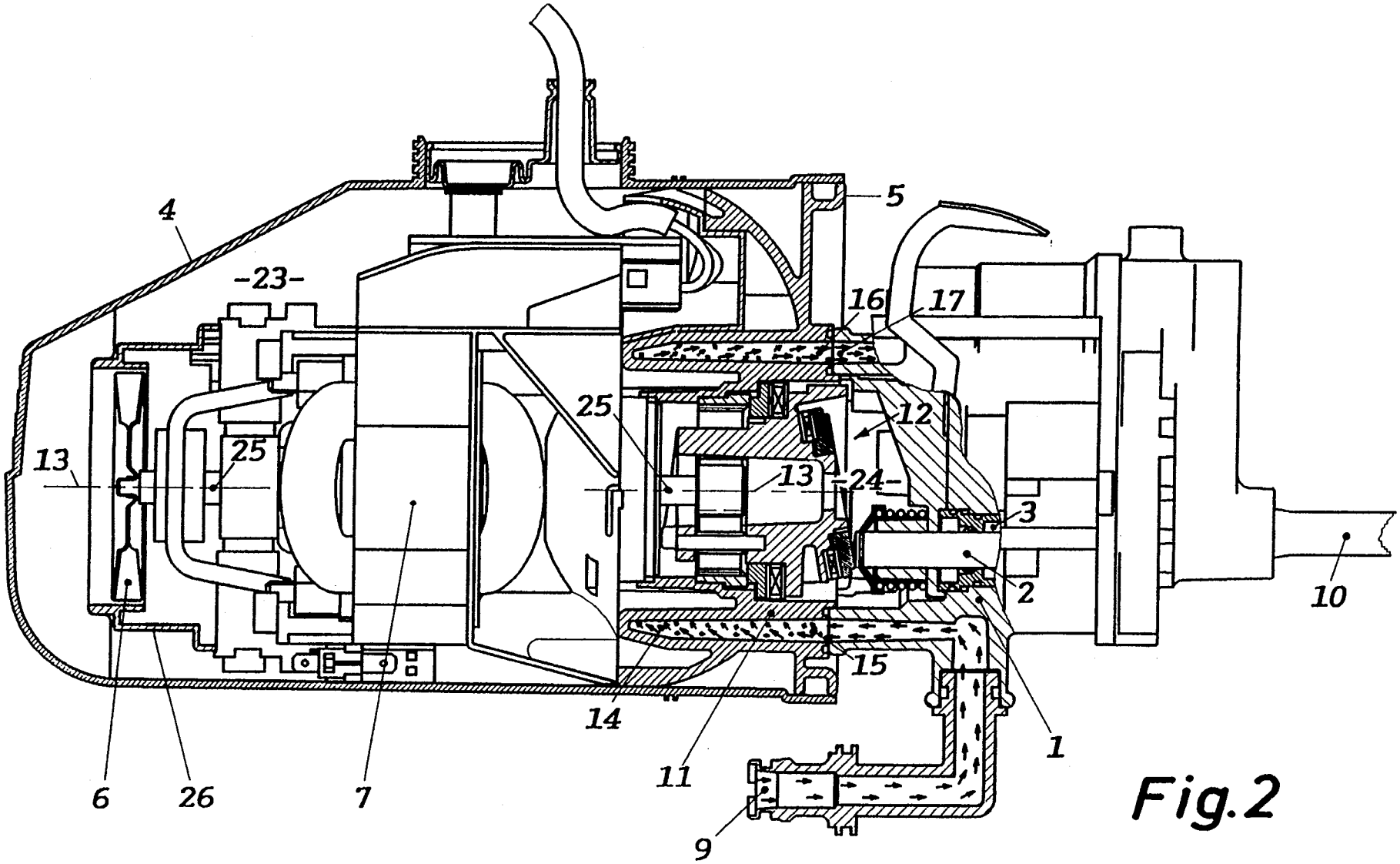
FIG. 2 is a view similar to FIG. 1, but shows the liquid-flow portion of the air cooler and the pump in longitudinal section
Figure 3:
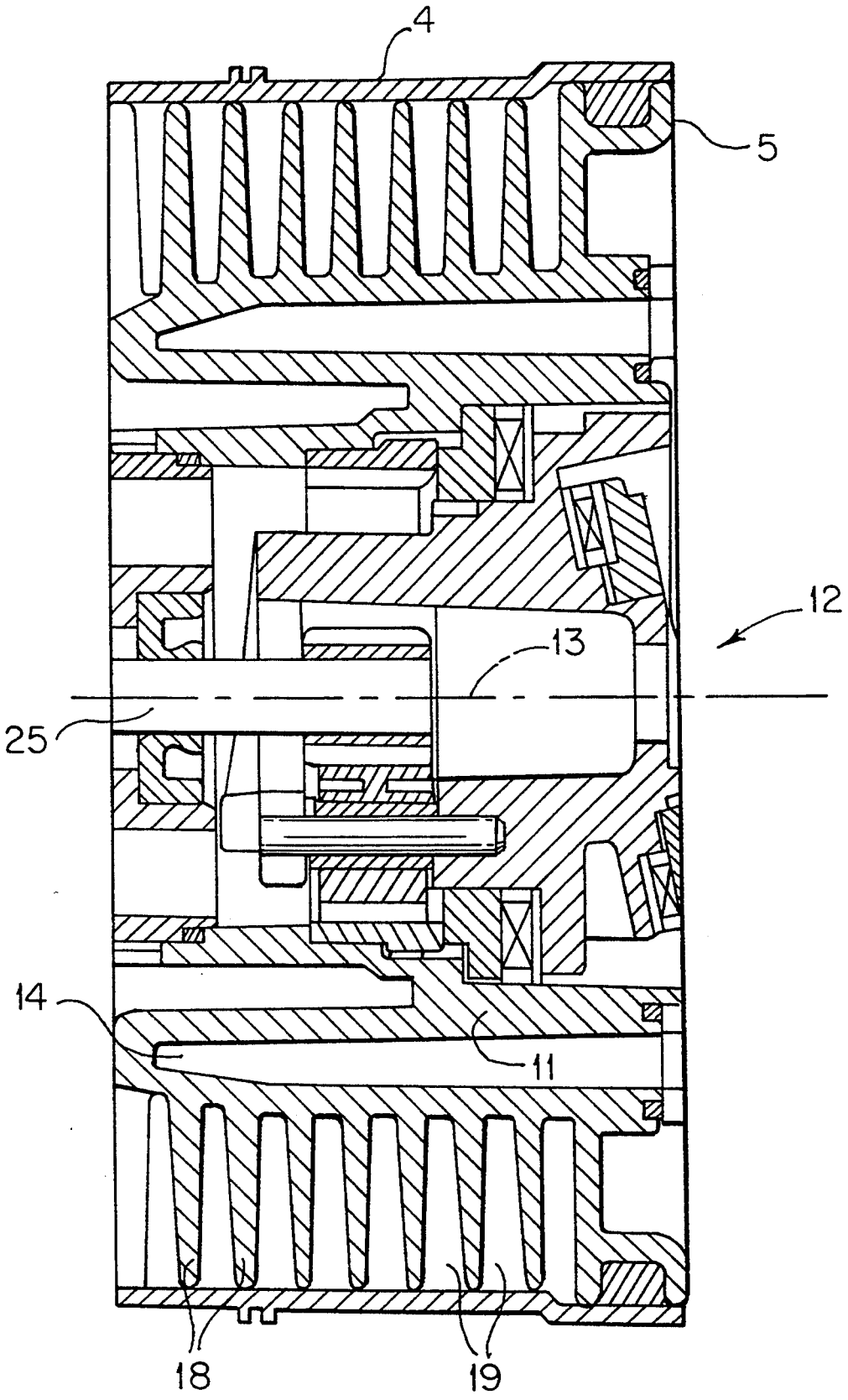
FIG. 3 is a cross sectional view, taken generally along line A—A of FIG. 1, of the swash-plate drive mechanism.

As may be seen from FIG. 2, the pump housing 1 and the drive-mechanism housing 11 between them enclose a substantially closed mechanism space 24 containing substantial parts of the drive mechanism 12 as well as parts of the pistons 2. This mechanism space 24 will normally contain a quantity of lubricating oil (not shown) to lubricate the cooperating parts of the drive mechanism and the pistons. As the casing space 23 is in direct contact with the radially inner wall of the drive-mechanism housing 11, the lubricating oil and hence the drive mechanism 12 will also be cooled by the cleaning liquid entering the cleaner through the inlet 9 and flowing through the annular-section flow space 14.

In the preferred embodiment shown, the shaft 25 of the motor 7 extends from both ends of the latter, carrying the fan 6 on the left-hand and the rotating part of the swash-plate drive mechanism 12 on the other. To ensure that the air flowing from the air-exit portion 22 to the inlet of the fan 6 is made to flow within the structural parts of the motor 7, the fan 6 is surrounded by a cowling 26 roughly in the form of a collar.

As will be seen when comparing FIGS. 1 and 2, the air flowing through the air channels 19 flows in substantially the same direction as the cleaning liquid flowing through the liquid-flow part 14, i.e. the air cooler 8 acts as a "co-current" heat exchanger. If heat exchange of the counter-current type is desired, it will be sufficient to reverse merely one of the flows mentioned, e.g. by reversing the liquid conduit connections to the flow space 14, thus making the point 16 the inlet and the point 15 the outlet point.

A high-pressure cleaner of this type will normally comprise various accessories, such as handles, electrical switches etc., but as these components are not affected by the present invention, they have not been described.

I claim:

1. A high-pressure cleaner comprising:

a) a pump for pumping cleaning liquid, the pump including a drive mechanism, b) an air-cooled motor for driving the drive mechanism of the pump, c) an air cooler adapted to be cooled by said cleaning liquid when the cleaning liquid flows through the air cooler to said pump, and d) air-circulating means for circulating air between said motor and said air cooler in an enclosure containing the motor and the air cooler, the improvement comprising a liquid-flow part of said air cooler through which said cleaning liquid flows in intimate thermal contact with or integral with a separate housing within said enclosure, containing the drive mechanism of said pump.

2. Cleaner according to claim 1 wherein said pump is of the axial-piston type including pistons and having a substantially circularly cylindrical housing surrounding a swash-plate mechanism for moving said pistons substantially coaxial to the drive-shaft axis of the drive mechanism, said liquid-flow part of said air cooler constituting at least a part of said housing and acting as a water jacket around said drive mechanism.

3. Cleaner according to claim 1 wherein a part of said air cooler through which air flows comprises a plurality of ribs in intimate thermal contact with or integral with said liquid-flow part, said ribs forming between them air channels adapted to guide said air in an air path leading from an air-entry portion through an intermediate portion to an air-exit portion, said air- entry and air- exit (22) portions being directed respectively away from and towards an otherwise substantially closed enclosure surrounding said motor.

4. Cleaner according to claim 3, wherein said air path is adapted to guide said air in a direction substantially opposite to that in which said cleaning liquid flows through said liquid-flow part.

5. Cleaner according to claim 1 wherein the pump mechanism includes a space containing a quantity of lubricating oil, and wherein said space has at least one wall in intimate thermal contact with or in common with said liquid-flow pat of said air cooler.

6. Cleaner according to claim 1, wherein said motor comprises an electric motor of an open-structure type including a motor shaft, and wherein a) said air-circulating means comprises a fan coupled to one end of the motor shaft, b) said pump is coupled to the opposite end of the motor shaft, and c) said motor and fan are enclosed in a common electrode.

7. Cleaner according to claim 6, wherein said fan is surrounded by a cowling adapted to guide the circulating air into the spaces between structural parts of the motor.

8. Cleaner according to claim 1, wherein said liquid-flow part of said air cooler comprises or constitutes an annular-section flow space surrounding said drive mechanism, said flow space having an inlet and outlet disposed substantially diametrically opposite each other.

* * * * *

UNITED STATES PATENT AND TRADEMARK OFFICE

CERTIFICATE OF CORRECTION

PATENT NO. : 5,338,162

DATED : August 16, 1994

INVENTOR(S) : KRARUP, Karsten

It is certified that error appears in the above-identified patent and that said Letters Patent is hereby corrected as shown below:

Column 2, line 15: change "Jet" to réad --jet--

Column 4, lines 31 and 32:

change "electrode" to read --enclosure--.

Signed and Sealed this

Sixth Day of December, 1994

*Attest:*

*Attesting Officer*

BRUCE LEHMAN

*Commissioner of Patents and Trademarks*